United States Patent [19]

O'Shea et al.

[11] 4,422,485

[45] Dec. 27, 1983

[54] INTEGRATED MOBILE TANK-SERVICING SYSTEM

[75] Inventors: Ronald J. O'Shea; Joseph P. Balkey, both of Charleston; Andre Hooper, South Charleston; Richard A. Kelly, III, St. Albans, all of W. Va.

[73] Assignee: Union Carbide Corporation, Danbury, Conn.

[21] Appl. No.: 307,217

[22] Filed: Sep. 30, 1981

[51] Int. Cl.[3] ..... B65B 3/04

[52] U.S. Cl. ..... 141/98; 141/232; 141/284; 141/387; 105/241.1; 182/230; 414/345

[58] Field of Search ..... 141/231, 232, 233, 98, 141/387, 388, 389, 250–284, 285–310; 105/241.1; 405/201; 169/24; 414/345, 334, 335; 137/236, 615; 182/82, 230

[56] References Cited

U.S. PATENT DOCUMENTS

| | | | |
|---|---|---|---|
| 2,192,736 | 3/1940 | Earl | 141/284 |
| 2,948,306 | 8/1960 | Kuraeff | 141/284 |
| 3,023,831 | 3/1962 | Bevis . | |
| 3,675,721 | 7/1972 | Davidson et al. | 169/24 |
| 3,700,014 | 10/1972 | Scales et al. | 405/201 |
| 3,799,217 | 3/1974 | Bauer . | |
| 4,037,664 | 7/1977 | Gibson | 169/24 |
| 4,224,968 | 9/1980 | Bosser et al. | 141/284 |

FOREIGN PATENT DOCUMENTS 2412824 7/1979 France .

OTHER PUBLICATIONS

"Loading Arm Assemblies", Emco Wheaton Inc., Catalog E-12/72, Rev. 9/74, 5M, 10/80.

Garsite Aviation Hydrant Servicers, (Model HS/1000).

*Primary Examiner*—Houston S. Bell, Jr.

*Attorney, Agent, or Firm*—George A. Skoler; Gary L. Wamer; Norman L. Balmer

[57] ABSTRACT

An integrated mobile tank- servicing system for filling, transferring, etc. a flowable medium from one or more tanks; said system having a mobile frame with an adjustable duct(s) for placement in the orifice of a tank and an adjustable walkway associated with the mobile frame.

19 Claims, 7 Drawing Figures

INTEGRATED MOBILE TANK-SERVICING SYSTEM

FIELD OF THE INVENTION

The invention relates to an integrated mobile tank-servicing system for use in servicing tank(s) on railway cars or road vehicles wherein is contained a flowable medium, such as a liquid or a slurry.

BACKGROUND OF THE INVENTION

The servicing of tanks in an industrial or commercial environment, i.e. the transfer of a flowable medium to or from a tank, has been traditionally achieved by aligning (generally referred to as "spotting") one or more tanks parallel to a fixed platform filled with filling-ducts so as to provide for access to the tank by personnel involved in the filling operation. The tank must be carefully positioned relative to the fixed platform to provide for the proper positioning of the filling-duct into the orifice of the tank. This is generally achieved by maneuvering the tank such that the tank is moved to the proper "spot" relative to the filling ducts on the fixed platform. Since access to the tank by the personnel carrying out the filling operation is also required, generally for the purpose of carefully aligning the duct with the orifice of the tank, the spotting of the tank becomes critically important. Unfortunately, to place the tank in its correct position relative to the fixed platform the tank must be moved to the correct "spot" by means external to the tank, e.g. a locomotive. Accordingly, the time and personnel which must necessarily be employed preparatory to the filling operation can be time consuming and expensive. This is especially true when railroad truck cars are being filled since the tank cars must usually be uncoupled prior to the filling operation; this being solely for the purpose of enabling the correct alignment of the tank car in relation to the fixed filling platform, i.e. to allow for correct "spotting" of the tank car. Further, this required alignment of the tank requires that a locomotive or similar device be dedicated to the filling operation, since the incidence of use for the filling operation is high, or costly delays will occur. This involves a costly capital investment for such a dedicated locomotive or like device.

The time and cost associated with the use of a conventional fixed filling platform should also be considered in view of the significant safety aspects of employing a filling system which requires constant movement, coupling, uncoupling, etc., of tank cars during the filling operation. Any filling system which reduces the risk of injury to the personnel associated with the filling operation by way of reducing unnecessary movement of the tank cars will necessarily result in an improvement in the overall safety of the filling operation.

The conventional fixed filling platform employed in industriai and commercial facilities today and discussed above are concrete and/or steel structures permanently affixed at a designated location in the industrial or commercial facility. The platform is equipped with one or more loading arm assemblies (typically of the top loading or bottom loading type) typically with a platform at the tank filling height or vertically adjustable to the height of the tank after the tank has been correctly spotted. The loading arm may be most any of the conventional and commercially available types such as a sliding tube assembly, "A" frame assembly, bottom transfer assembly, rail car assembly, or any of the commonly available loading arm assemblies (such as available from Emco Wheaton Inc. Catalog E-12/71, Rev. 9/74, 5M 10/80, "LOADING ARM ASSEMBLIES").

In addition to the safety, capital cost and time aspects associated with a fixed platform loading system, such a system has certain other undesirable features. For example, not only is such a fixed system dependent on a dedicated locomotive or like means to continually move the heavy tanks to and from the "spot", but the constant movement of such loads, generally in excess of 1000 tons, involves a high capital expenditure in terms of the cost of the energy used to move such loads. Further the time intensive spotting operation is equally costly. Further, the fixed nature of such a conventional system makes maintenance (such as for repairs, general maintenance, cleaning, etc.) difficult since it necessary to move elaborate repair, cleaning and/or maintenance equipment to the fixed system. Since the fixed filling system is generally in a remote region of an industiral or commercial facility e.g., associated with a railroad yard or a truck yard, this requires that the maintenance be carried out at considerable inconvenience and cost. Further, such a fixed system is dedicated to carrying out all filling operations at only one location and cannot provide for many of the filling or transfer needs present elsewhere at a facility, such as the transfer of a liqud from a single tank at multiple locations.

Although commercial and industrial users of the fixed filling platforms have recognized the limited usage, high capital expenditure, and high operating costs associated with such fixed filling platforms, this system remains today as the commonly employed system in the industry owing in large part to the lack of availability of any alternative system.

The use of a mobile filling system in an industrial and/or commercial environment wherein the tank(s) would remain stationary relative to the filling system during the filling operation has not heretofore been disclosed in the art since the available hydrant services (such as used in the aviation industry and as available from Garsite Products, Inc., 10 East Grant Blvd., Deer Park, L.I. N.Y.) were single servicing units with design deficiencies, e.g. the lack of rigid connector for the filling means, and thus were unsuitable for the multi-tank filling requirements found in industrial and commercial facilities. Further, when employed in filling a tank car, be it a railway or roadway car, the known hydrant servicers did not provide for access to the tank car since such access was not required when filling an airplane with fuel since the means by which access to a specific tank was obtained was simply by the movement of the hydrant servicer to the single airplane tank. These and other deficiencies made such hydrant servicers totally unsuitable for the industrial and/or commercial servicing of tank cars.

To obviate these problems the instant invention provides for a tank-servicing system wherein the problems associated with the conventional fixed platform filling system are overcome by providing a system having a mobile frame, variable (i.e. multidirectional), ducts, and variable access means which by integrated interaction during the servicing operation significantly decrease the time and cost associated with servicing tank cars. This mobile tank-servicing system is generally referred to hereinafter as "Bessy".

SUMMARY OF THE INVENTION

Figure 1:
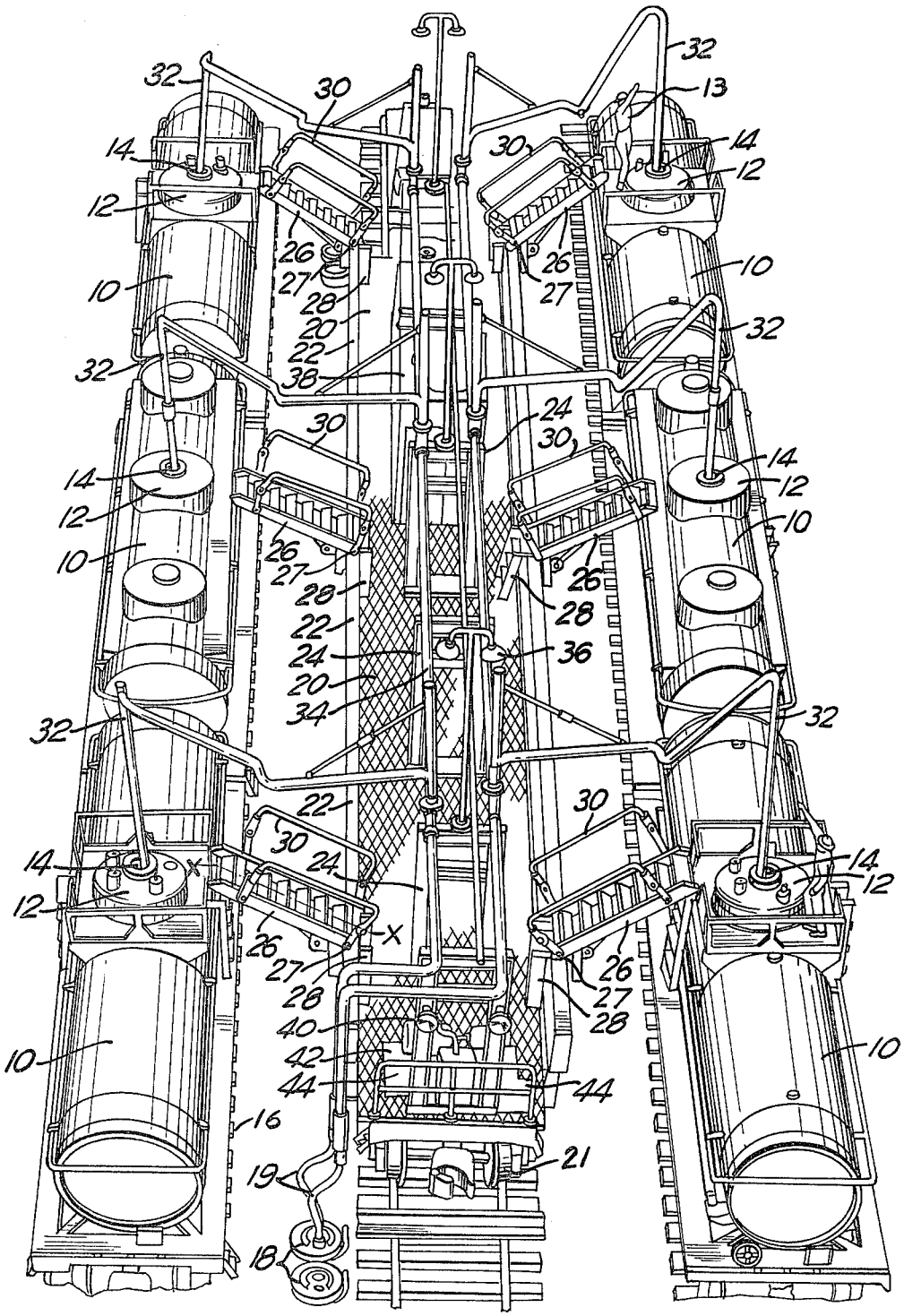
FIG. 1 is a diagrammatic perspective view of an embodiment of a mobile tank-servicing system, i.e., a "Bessy", according to the invention.

The instant invention relates to a mobile tank-servicing system, i.e. a Bessy, and the employing thereof wherein said mobile tank-servicing system comprises a mobile tank-servicing system with variable ducts and variable access means affixed to a mobile frame for use in transfering a flowable medium to or from a tank, more particularly Bessy comprises:

(a) a mobile frame to be arranged substantially parallel to one or more tanks;

(b) one or more variable ducts with extension means for insertion in an orifice of said tank(s), said duct(s) being capable of multi-directional movement relative to said frame and said tank(s); and (c) one or more variable access means for providing access from said mobile frame to said tank(s), said access means being capable of multi-directional movement relative to said mobile frame and said tank(s) whereby said variable duct(s), mobile frame and variable access means may be independently moved to provide an integrated interaction that provides for servicing and access to said tank(s).

DETAILED DESCRIPTION OF THE INVENTION

The transfer of a flowable medium to and from a tank(s) has been tediously practiced in the same manner for decades owing to the failure of an acceptable alternative tank-servicing system to replace the time-honored fixed platform systems presently in use. Unfortunately, those fixed platform systems presently in use have several deficiencies, as above discussed, which have always made their use tedious and inefficient in terms of capital investment, manhours required for operation and the cost of operation and maintenance.

A tank-servicing system that overcomes the inherent difficulties associated with fixed platform system and having certain desired features, as hereinafter discussed, would be greatly preferred but heretofore such a system has been unavailable. Since a system having the hereinafter set forth features and advantages has not heretofore been available the inventors hereof have chosen to refer to this new mobile tank-servicing system as "Bessy", since any relation to existing systems is deemed inappropriate. These desired features include:

(1) a system which requires minimal energy consumption, e.g. the constant "spotting" of tank cars weighing 1000 tons or more is an energy intensive operation;

(2) a system which is not critically dependent on a locomotive, e.g. any system which requires the movement of several tank cars (e.g. over 5) requires a locomotive (or equally powerful device) to transport the tank cars and, thus, is critically dependent on the locomotive which may and often is in use in plant operations away from the tank-servicing site (in addition, the high cost of a locomotive which is often in excess of a million dollars);

(3) a system that requires less capital investment and has low operating costs (both in terms of maintenance and manpower);

(4) a system that is simple, reliable and which may be easily maintained;

(5) a system that is mobile so that it may be used at almost any location in an industrial and/or commercial facility and may be transported to a location for repair, cleaning and used in loading, unloading, transfer operations, and the like;

(6) a system that enhances the safety of tank-servicing operations by minimizing the movement of the tank cars during the servicing operation;

(7) a system that does not place a limit on the number of tanks to be serviced, e.g. the number of tank cars that may be serviced is not dependent on the ability to pull the tank cars to the service station;

(8) a system that provides for a faster servicing operation than the fixed platform system by eliminating the time intensive operation of spotting the tanks; and (9) a total system which includes operator transport-ducts, access means, product loaders and receivers, lights, power, communication, equipment, pumps, filters, meters, piping, fluid cutoffs and the like, in a single tank-servicing system.

The instant invention provides such a tank-servicing system, for use in the transfer of a flowable medium to or from a tank(s) which provides the aforementioned features by providing a mobile tank-servicing system, i.e. Bessy, which comprises:

(a) a mobile frame to be arranged substantially parallel to one or more tanks;

(b) one or more variable filling-ducts for insertion in an orifice of said tank(s), said duct(s) being capable of multi-directional movement relative to said frame and said tank(s); and (c) one or more variable access means for providing access from said frame to said tank(s), said access means being capable of multi-directional movement relative to said frame and said tank(s) whereby said variable duct(s), mobile frame and variable access means may be independently moved to provide an integrated interacting tank-servicing system that provides for servicing and access to said tank(s).

The term "servicing" as used in association with the phrase "tank-servicing system" is meant to cover the various operations which may involve the introduction to and/or removal from a tank of a flowable, i.e. a fluid, medium.

Bessy will be more completely understood by reference to the drawings discussed hereinafter.

Figure 6:
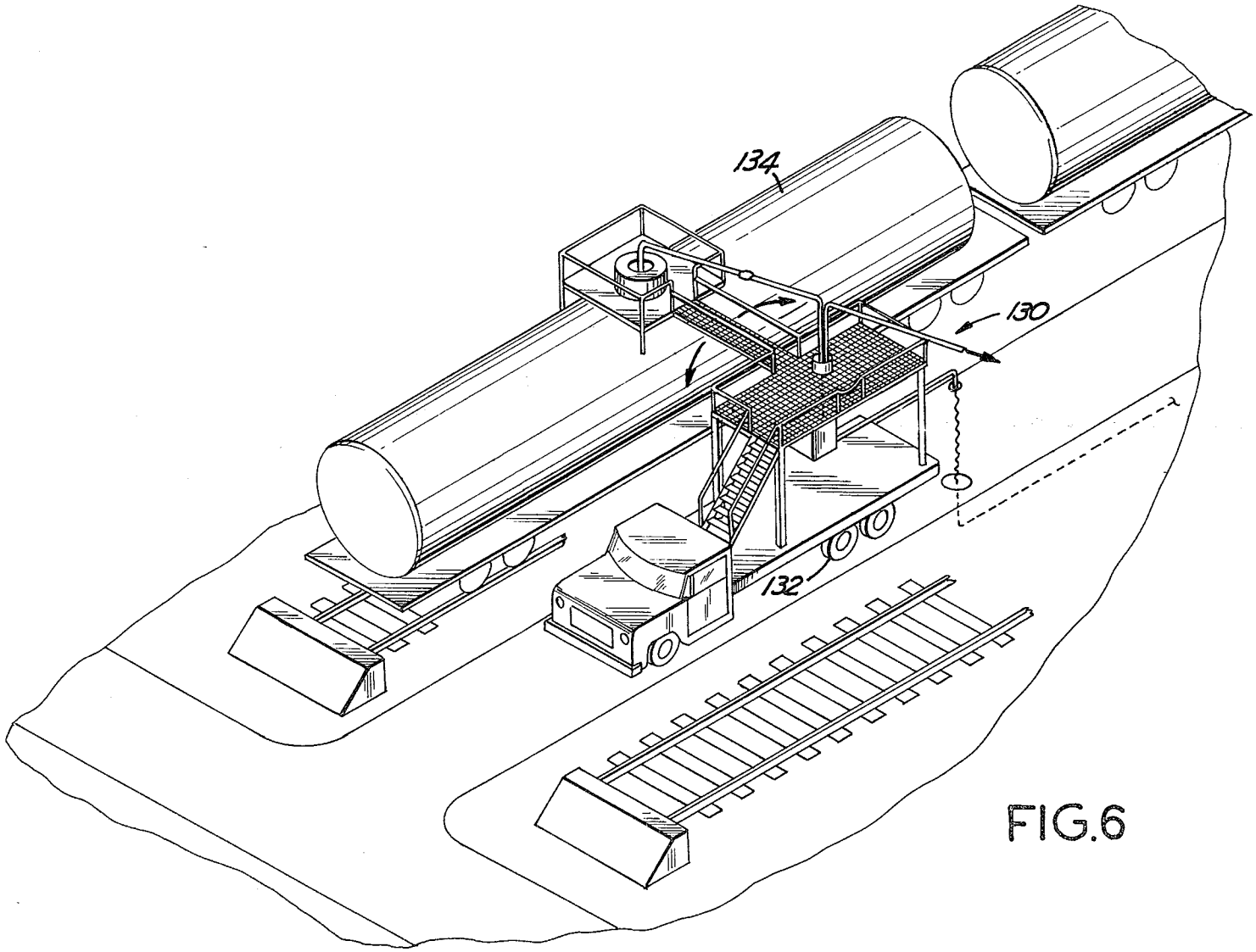
FIG. 6 is a diagrammatic perspective view of Bessy wherein a rubber tired system is employed.
Figure 7:
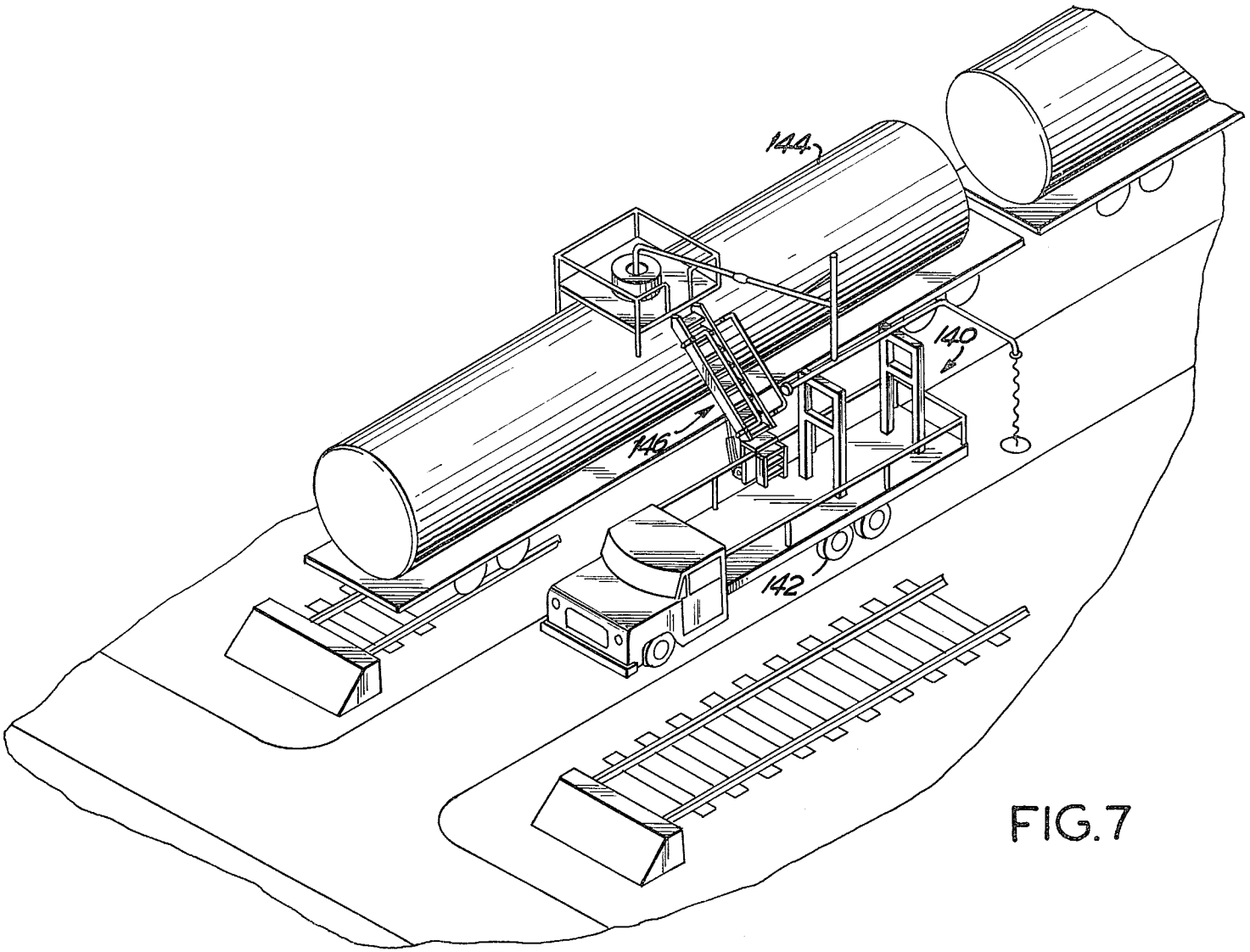
FIG. 7 is a diagrammatic perspective view of Bessy wherein a rubber tired system is employed.

Referring to FIG. 1, the tanks to be serviced are shown as railway tank cars 10 on railway track 16 having access area 12 and filling orifice 14. Although the drawing(s) illustrates a railway tank car, it will be evident to those skilled in the art that the following description equally applies to roadway tank cars and/or stationary tanks. For example, if a road tank car is employed during the servicing operation, the mobile tank-servicing system may be placed on rubber tires and used on a roadway rather than on a railway. (Such embodiments are shown in FIGS. 6 and 7 and are discussed hereinafter). In addition, for simplicity, the tanks are shown with servicing at only one orifice, i.e. a one compartment tank, although multiple-compartment tanks are advantageously serviced by employing the mobile tank-servicing system of the invention.

Bessy, as depicted in FIG. 1, comprises a mobile frame formed of a railroad flat car or other like flatbed-type structure having platform 20, side members 22 and wheels 21. The mobile frame serves as the structural backbone of the mobile tank-servicing system as it provides the backbone upon which are affixed the multidirectional access means, shown as multidirectional ladders, and the multidirectional ducts.

The terms "multidirectional" or "variable" as used herein are used synonymously and mean the ability of the access means and ducts to move in three-dimensional space, i.e. vertically, horizontally and in the direction substantially perpendicular to the tank and the mobile frame. The use of such multidirectional access means and ducts on a mobile frame, wherein said access means and ducts move independently of one another, provides a mobile tank-servicing system that possesses the aforementioned desired features by providing an integrated interaction of the variable duct(s), variable access means and mobile frame during the tank-servicing operation.

The multidirectional access means 26 and associated platform access means 28 are movable with respect to side member 22 in the longitudinal direction along side member 22 by means of a slide arrangement (shown in detail in FIG. 4 and discussed hereinafter) such that during the operation of Bessy access means 26 can be accurately positioned at the correct horizontal position to provide for access to access area 12 of tank car 10 so as to provide for proper placement of duct 32 into orifice 14 of tank car 10. Platform access means 28 is provided on the inner side of side member 22 to provide for access to access means 26 from platform 20 and is slide mounted to provide for movement in the longitudinal direction along the innerside of side member 22 in the same manner as access means 26 is moved.

During operation Bessy is moved so as to be substantially parallel to one or more tanks. Access means 26 and platform access means 28 are moved in the longitudinal direction and the access means 26 is aligned to engage access area 12 of tank 10. To provide such alignment capability the access means must be capable of vertical displacement and displacement in the direction perpendicular to the mobile frame and with respect to tank car 10. Access means 26 is shown herein as a ladder having an axis 27 about which access means 26 rotates to provide for such desired movement. Such rotation provides for both vertical displacement and displacement in the direction of the plane defined by the perpendicular with respect to mobile frame and with respect to tank car 10. It will be understood that movement of the access means in an angular direction such that the outer edge of the access means defines a circle with axis 27 as its center is a vertical and a perpendicular displacement, as above described, since such angular movement can be reduced to its vertical and perpendicular components relative to the tank car and/or the mobile frame. The access means 26 depicted in FIG. 1 is a multidirectional ladder, slide mounted on side member 22 and pivotal about axis 27 and fitted with side rails 30, said side rails provided to provide safety for an operator using access means 26 to reach access area 12 of tank car 10 during the servicing operation.

FIG. 1 depicts Bessy during the concurrent servicing of six railway tank cars although Bessy may be employed for more or less than six tank cars, as desired. For example, if only two tank cars are to be serviced then Bessy would necessarily include only two access means and two filling ducts on a mobile frame whereas if eight tanks are to be serviced Bessy will have eight ducts and eight access means. Such variations are within the scope of the invention.

Ducts 32 are of the generally available type of loading arm assemblies with swing joints to provide for multidirectional usage and may also be flexible hoses (preferably of the metal type). Multidirectional ducts which may be employed herein are available from Emco Wheaton, Inc., Catalog E-12/72. Ducts 32 are serviced by lines 34 (i.e. receive flowable medium from) positioned on support members 24 affixed to platform 20, through which the flowable medium passes to be transferred and/or to be removed from the tanks. The flowable medium may comprise most any liquid or gaseous medium which is a fluid under the temperatures of the tank-servicing operation and may be a solid medium so long as the medium is flowable, e.g. a finely divided solid or a solid dispersed in a liquid carrier (e.g. a slurry). It is anticipated that the flowable medium will generally be a liquid in most applications of Bessy. Line 34 is connected to a hydrant for transfer of flowable medium to the tank, such as hydrant 18 which is shown as an inground hydrant, with flexible connector 19 with a connection means, such as a dry-break (not shown), providing the connection between hydrant 18 and line 34. Although hydrant 18 is shown as an inground hydrant, the use of above ground hydrants, the use of above ground overhead hydrants and the like, may be employed by simple relocation of lines 34 for connection with the selected hydrant type.

Bessy will generally comprise other general support features such as lights 36, public address system 40, generator 42 (or 42 may be an engine), guard rails 44 and a control center 38. In addition, pumping means may be added when Bessy is employed for the transfer of a fluid medium from one tank to another tank. The control center may contain all commonly used control features including operator comfort facilities, power source, communications equipment, metering guages and the like (said control features are not shown).

During the tank-servicing operation (described for the concurrent filling of six tanks) shown in FIG. 1 the Bessy is positioned substantially parallel between the first three tank cars on each of two substantially parallel railway tracks. Since Bessy is mobile the tank cars need not be moved during the tank-servicing operation and the use of a locomotive is not required, i.e. undue movement of the tank cars is prevented, since Bessy is moved when any further movement is required. In this respect the phrase without "undue movement" means that movement of said tank car(s) that comprises more movement than the mere placement of one or more, preferably more than one, tank car on a railroad track or roadway and, particularly, includes "spotting" insofar as such involves the alignment of said tank car(s) at a fixed filling platform as contrasted with alignment of Bessy with a tank car. Bessy may be positioned with a Unimog (TM of Mercedes Benz, Corporation for a heavy duty diesel truck) or the like device since Bessy will typically weigh only 10 to 20 tons. In addition, Bessy may be self propelled by adding an engine to Bessy, e.g. at 42 (engine not shown). (This is not the case which occurs when a fixed platform system is employed and when several heavy tank cars are to be moved.) Since the accommodation of all vertical, horizontal and perpendicular adjustments, as hereinbefore discussed, are accommodated by the integrated interaction of Bessy the decoupling and spotting of the tank cars is avoided as are the cost, time and manpower associated with such decoupling and spotting operations. Bessy is positioned substantially parallel and adjacent to the six tank cars and the six access means 26 are moved in a longitudinal direction to access areas 12 of each tanks 10 after which access means 26 is rotated downward about axis 27 to rest on access area 12 of tank 10, respectively. Line 34 is connected to hydrant 18 via flexible connector 19. An operator 13 accesses each tank 10 from platform 20 via platform access means 28 and access means 26 for placement of duct 32 in orifice 14 of tanks 10 after which the filling operation is carried out by appropriate metering of the flowable medium to tanks 10. After the filling operation is completed filling duct 32 is removed from orifice 14 and access means 26 is rotated about axis 27 in the direction of platform 20. Line 34 is disconnected from hydrant 18. Bessy is now moved to six different tank cars, i.e. undue movement of the tank cars is eliminated, and the above filling operation is repeated.

Although the above description relates to a tank-filling operation it will be understood that by simple adjustment in the piping that the flowable medium may be transferred between tanks and tanks may be unloaded, i.e., the flowable medium removed.

The material of construction of Bessy is of conventional design and construction as are the various control features, meters, valves and the like. Non-corroding materials are selected based, in part, on the flowable medium to be employed in the servicing operation. For example, the connection to hydrant 18 is generally made with a conventional stainless steel dry-break coupler such as those available from Emco Wheaton Inc., Product Bulletin No. 23 (May 1978). The mobile frame of a Bessy to be employed in servicing railroad tank cars may be formed by modifying a standard railroad flat car.

Figure 2:
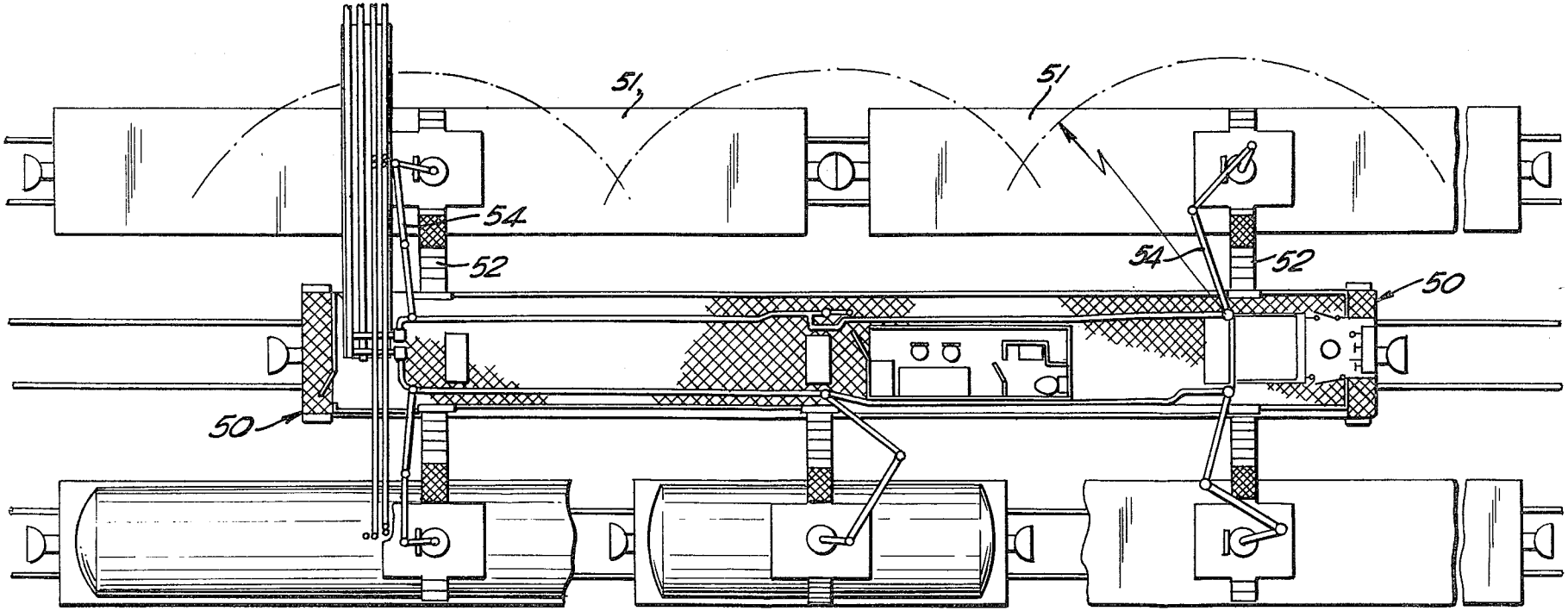
FIG. 2 is a top view of Bessy according to the invention.

FIG. 2 depicts a simplified top view of a Bessy 50, as depicted in FIG. 1 showing the interaction of variable duct means and variable access means. The dotted lines represent the positions within which a tank 51 may be placed, accessed and serviced without further movement of the tank, i.e., serviced without spotting. Access means 52 may be moved along Bessy to any desired position as hereinbefore discussed with reference to FIG. 1. As is clear from FIG. 2, a tank 51 may be accessed and serviced by duct 54 and access means 52 in any of the area adjacent Bessy. This eliminates undue movement of the tank cars during the servicing operation. The features of the Bessy in FIG. 2 are as described in FIG. 1.

Figure 3:
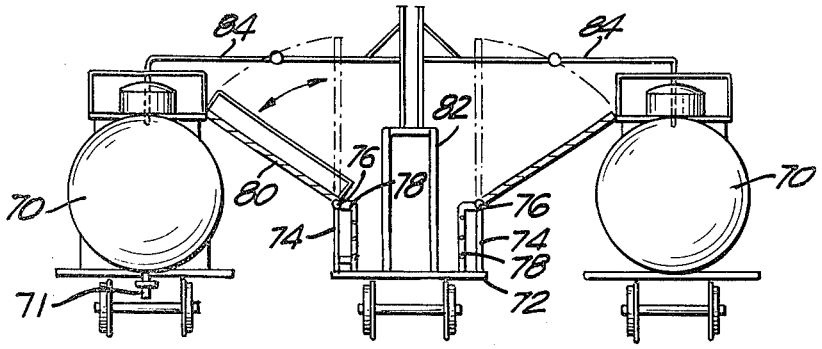
FIG. 3 is an end view of a Bessy as seen perpendicular to the track axis.

FIG. 3 shows an end view of a Bessy as depicted in FIG. 1 taken along the direction of the track axis wherein two tank cars 70 are to be serviced. Access means 80 are rotated to rest on tank cars 70 after having been positioned by movement on slide means 76 (detail shown in FIG. 4) or other adjustable means on side member 74 affixed to platform 72. Duct(s) 84 supported by support member 82 is inserted into the orifice of tank car 70 by an operator (not shown) that accesses tank 70 by way of access means 78 and platform access means 80, as hereinafter discussed with reference to FIG. 1.

Figure 4:
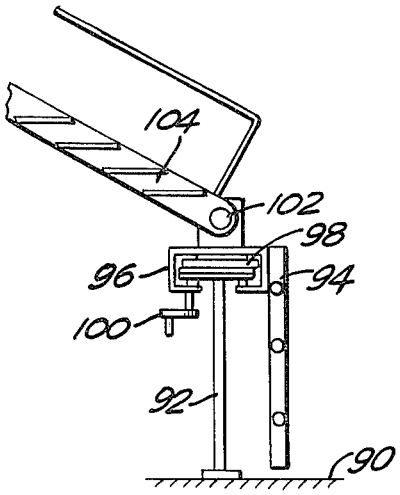
FIG. 4 is a view taken along line X—X of FIG. 1.

FIG. 4 shows a slide means arrangement such as that shown by an end view taken along line X—X of FIG. 1 having a slide means depicted for use in affixing an access means 104 to a side member 92 of Bessy for movement in the longitudinal direction along Bessy. Side member 92 is mounted on platform 90, as hereinbefore described. Access means 104 and access means 94 are mounted on a slide means 96 which in turn is mounted on side member 92. Access means 94 is mounted on sliding means 96 to provide for access by the operator from platform 90 to access means 104 and the tank (not shown) to be serviced. Short sections of access means 94 are preferably fastened to slide means 96 to provide for additional fastening of access means 94. Once the slide means has been moved to the correct horizontal position on side member 92, during a filling operation, a friction brake 100 engages side member 92 and slide means 96 by means of brake member 98 to prevent movement of the slide means 96 and associated access means 104 and 94. Access means 104 may then be positioned for the servicing operation as hereinbefore described.

Figure 5:
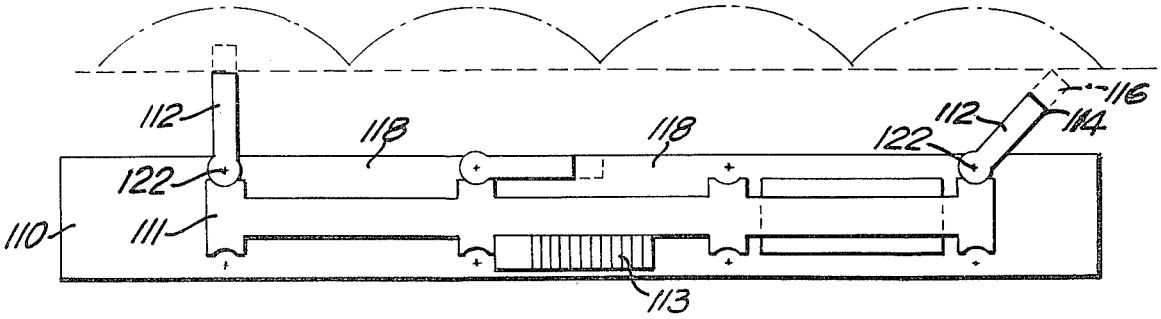
FIG. 5 is top view of a further embodiment of the invention.

FIG. 5 shows a simplistic top view of a Bessy wherein an alternative embodiment of the access means to a tank car is depicted. In this embodiment the access means depicted in FIG. 4 as a multidirection ladder is replaced by a extendable rotating gangway 112 affixed to a rotating post 122 on a walkway 111 above platform 110 at a height substantially equal to the vertical height of the access area of the tank to be serviced. The remaining features of this Bessy areas described for FIG. 1. The extendable rotating gangway 112 is affixed on a rotating support 122 on walkway 111 and has an extendable gangway 116 with a rotating joint 114 which may be provided to permit for movement of extendable gangway 116 in the vertical direction and in the direction perpendicular to the mobile frame and may be of any conventional type, e.g. a hinged type. Walkway 111 has recessed portions 118 wherein extendable rotating gangway 112 may be stored when not being used for a servicing operation. A stairway 113 is provided for access to walkway 111 from platform 110.

FIG. 6 shows a simplistic perspective view of a Bessy wherein Bessy 130 is a rubber tired Bessy adapted with tires 132 for use on a roadway with railroad car(s) 134 (or alternatively roadway cars) and is shown with access means as described in FIG. 5 (rotating joint similar to rotating joint 114 of FIG. 5, not shown), i.e. extendable rotating gangway. Otherwise, this Bessy is as described above with reference to FIGS. 1 and 5.

FIG. 7 shows a simplistic perspective view of a Bessy 140 is a rubber tired Bessy adopted with tires 142 for use with railway car(s) 144 (or, alternatively, with roadway cars) and is shown with access means 146 as depicted in FIGS. 3 and 4 and hereinbefore discussed. Otherwise, this Bessy is as hereinbefore described with reference to FIGS. 1, 2, 3 and 4.

It will be understood that, the invention, Bessy, is not intended to be limited to the details of the aforementioned embodiments, but includes variants, inter alia those differing only in the use of equivalent means. For example, FIGS. 6 and 7 depict for simplicity a Bessy being employed with a single tank car with the preferred use being with two or more tank cars in the same manner as described for the Bessy depicted in FIG. 1. Further, Bessy may be provided with spill containment and spill avoidance means such as flowmeters with automatic shutoff sensors or may have associated spill containment pass with pumping means for containment of any spill which may occur. Further, Bessy may be provided for use with tank cars having bottom loading, e.g. bottom orifice 71 of tank 70 in FIG. 3, by providing Bessy with pump means and connection means of conventional design. Further, Bessy may be covered with a protective shelter to provide protection for operating personnel. These and other variations are within the scope of Bessy.

What is claimed is:

1. A mobile system for effecting the transfer of a flowable medium with respect to at least one independent tank, said tank having an orifice for the flow of the flowable medium, comprising:

(a) a mobile frame adapted to be moved adjacent to the tank;

(b) at least one variable duct movably affixed at one end to the mobile frame and adapted for insertion into the orifice of the tank, said variable duct being adapted to provide for the multidirectional movement of its other end with respect to the mobile frame; and (c) at least one variable walkway movably affixed at one end to the mobile frame, said variable walkway being independent of the variable duct and being adapted to provide for multidirectional movement of its other end with respect to the mobile frame, said other end being adapted to contact the tank to provide access thereto, whereby said mobile frame, variable duct, and variable walkway are adapted for independent movement to provide an integrated interaction with the tank for access between the tank and mobile frame and for the transfer of a flowable medium with respect to the tank.

2. The system of claim 1 in which the frame has at least two variable ducts and two variable walkways and is adapted to provide for access and for the transfer of a flowable medium with respect to at least two tanks at the same time.

3. The system of claim 1 in which the variable walkway is a ladder.

4. The system of claim 1 in which the variable walkway comprises a telescoping walkway pivotably fastened at one end to the mobile frame to provide for horizontal and vertical movement with respect to the mobile frame.

5. The system of claim 1 in which the at least one tank is mobile.

6. The system of claim 5 in which the at least one tank is a railroad tank car.

7. The system of claim 6 in which the mobile frame is adapted to move in any direction with respect to the tank car.

8. The system of claim 6 in which the mobile frame is on a railraod chassis adapted to move on railroad tracks.

9. The system of claim 1 in which the mobile frame has at least one variable storage duct affixed at one end of the mobile frame and the other end adapted for communication with a storage tank, wherein the variable storage duct is in communication with at least one variable duct, whereby the transfer of flowable medium can be effected between the at least one tank and the storage tank.

10. A mobile system for effecting the transfer of a flowable medium with respect to at least two tanks at the same time, said tanks being independent of the mobile system and each of said tanks having an orifice for the flow of the flowable medium, comprising:

(a) a mobile frame adapted to be moved to be simultaneously adjacent to at least two of said tanks;

(b) at least two variable ducts, each movably affixed at one end to the mobile frame and adapted for insertion into the orifice of a tank, each of said variable ducts being independent and adapted for the multidirectional movement of its other end with respect to the mobile frame, whereby one of said variable ducts is adapted for communication with one tank and another said variable ducts is adapted for communication with another tank at the same time; and (c) at least two variable walkways, each independent and movably affixed at one end to the mobile frame, each of said variable walkways being independent of the variable ducts and being adapted for multidirectional movement at its other end with respect to the mobile frame, whereby one of said variable walkways is adapted to contact one tank and another of said variable walkways is adapted to contact another tank at the same time, whereby said mobile frame, at least two variable ducts, and at least two variable walkways are adapted for independent movement to provide integrated interaction with at least two tanks at the same time for access between the tanks and the mobile frame and for the transfer of a flowable medium with respect to the tanks.

11. The system of claim 10 in which the mobile frame is adapted to move in any direction with respect to the tank.

12. The system of claim 10 in which the at least two tanks are railroad tank cars.

13. The mobile system of claim 12 which is adapted to provide access and the transfer of a flowable medium to at least two tank cars that are abutting on the same railroad track.

14. The system of claim 10 in which the mobile frame is on a railroad chassis adapted to move on railroad tracks.

15. The mobile system of claim 13 in which the mobile frame is on a railroad chassis adapted to move on railroad tracks and the railroad tracks for the mobile frame are substantially parallel to the railroad tracks for the at least two tank cars.

16. The system of claim 15 in which at least one variable duct and at least one variable walkway are on each side of the mobile frame so that access to and transfer of flowable medium with respect to tank cars on opposite sides of the mobile frame can occur at the same time.

17. The system of claim 10 in which the mobile frame has at least one variable storage duct affixed at one end to the mobile frame and the other end adapted for communication with a storage tank, wherein the variable storage duct is in communication with at least one variable duct, whereby the transfer of flowable medium can be affected between the at least one tank and the storage tank.

18. The system of claim 10 in which the variable walkway is a ladder.

19. The system of claim 10 in which the variable walkway comprises a telescoping walkway pivotably fastened at one end to the mobile frame to provide for horizontal and vertical movement with respect to the mobile frame.

* * * * *